United States Patent [19]

Lee et al.

[11] 4,210,545

[45] Jul. 1, 1980

[54] OXIDATION RESISTANT LUBRICANT COMPOSITION

[75] Inventors: Richard J. Lee, Downers Grove; Eugene E. Richardson, Aurora, both of Ill.

[73] Assignee: Standard Oil Company (Indiana), Chicago, Ill.

[21] Appl. No.: 25,656

[22] Filed: Mar. 30, 1979

[51] Int. Cl.[2] ..... C10M 1/38

[52] U.S. Cl. ..... 252/47.5; 252/47; 252/402; 260/551 S; 544/53; 544/55

[58] Field of Search ..... 252/47, 47.5, 402; 260/125, 551 S; 544/53, 55

[56] References Cited

U.S. PATENT DOCUMENTS

| | | | |
|---|---|---|---|
| 2,484,257 | 10/1949 | Watson et al. | 252/47 |
| 2,620,303 | 12/1952 | Lowe et al. | 252/47 X |
| 3,252,910 | 5/1966 | Oberright | 252/47 X |
| 3,876,550 | 4/1975 | Holubec | 252/47 X |
| 4,049,807 | 9/1977 | Paulus et al. | 544/55 X |

*Primary Examiner*—Andrew Metz

*Attorney, Agent, or Firm*—William H. Magidson; William T. McClain

[57] ABSTRACT

Lubricant additives imparting oxidation inhibiting properties to lubricant compositions, are synthesized by reacting thioxamide, saturated aliphatic aldehyde of from 1 to about 20 carbon atoms, and an olefin of at least 8 carbon atoms, in the presence of a boron trifluoride catalyst.

9 Claims, No Drawings

OXIDATION RESISTANT LUBRICANT COMPOSITION

BACKGROUND OF THE INVENTION

In the development of petroleum lubricating oils the trend has been directed to more and more drastic refining methods to reduce the tendency of such oils to form carbon deposits and/or sludge. While such highly refined oils possess many advantages, their resistance to oxidation, particularly under severe operating conditions is generally decreased; they are more prone to form acidic oxidation products which are corrosive, and which cause undesirable increase in the viscosity of the lubricant.

To overcome the tendency of such highly refined oils to form carbon and/or sludge deposits on various operating parts of the engine, such as pistons, piston rings, valves etc., various oil-soluble metal-containing detergent compounds, now well-known in the art, have been incorporated in such lubricating oil compositions. Such metal-containing organic compounds, while effective as detergents for dispersing the precursors of deposits within the oil itself rather than permitting them to form deposits on the engine parts, had the disadvantage of forming ash deposits in the engine. To overcome this disadvantage, so-called ashless detergents were developed, and are now well-known in the art.

The organic compounds, both the metal-containing and the ashless, while imparting detergency properties to the lubricating oils containing the same do not inhibit the oxidation of such lubricating oils at high temperature operating conditions. The compounds of the present invention, hereinafter described, are effective in inhibiting the high temperature oxidation of such lubricating oils.

SUMMARY OF THE INVENTION

In accordance with the present invention, oxidation inhibitors effective in preventing the oxidation of lubricating oils at high temperatures are obtained by the process comprising: dissolving in molar ratios about 0.1 moles to about 1.0 moles of thio-oxamide, from about 0.2 moles to about 2.0 moles of a saturated aliphatic aldehyde having from one to about 20 carbon atoms, and from about 0.2 mole to about 2.0 moles of an olefin hydrocarbon having at least 8 carbon atoms, preferably from about 8 to about 20 carbon atoms, in a suitable organic solvent such as, for example, chloroform, benzene, chlorobenzene, and the like, and agitating the resultant solution, while cooling the same to a temperature in the range of about 34° F. to about 38° F. While maintaining such temperature, from about 10 parts per 100 parts to about 20 parts per 100 parts, preferably about 11 parts per 100 parts of boron trifluoride etherate are slowly added to the cooled solution. After about one hour reaction at the temperature of about 34°–38° F., from about 5 parts per 100 parts to about 10 parts per 100 parts additional boron trifluoride etherate are slowly added, and the reaction temperature is allowed to gradually reach room temperature, i.e., about 78° F. in about 10–12 hours. The reaction mixture is then treated with a base, e.g. sodium hydroxide, until alkaline (pH 8). The solvent phase, e.g. chloroform, is separated from the aqueous phase, and the latter washed with fresh solvent. The combined mother liquor and the solvent wash are then dried over sodium carbonate, and the resultant dried mixture distilled under vacuum at a temperature up to about 260° F., and the solvent-free reaction product recovered.

Illustrative of alkyl aldehydes which can be used in the above described process are, by way of example: formaldehyde, acetaldehyde, propionaldehyde, n-butyraldehyde, iso-butyraldehyde, 2-ethylhexaldehyde, nonylaldehyde, lauraldehyde, caproaldehyde, heptaldehyde, myristaldehyde, pentadecanal, heptadecanal, and the like.

The following olefin hydrocarbons are illustrative of those which can suitably be used in the hereindescribed process: octene, nonene, decene, undecene, dedecene, tridecene, tetradecene, pentadecene, octadecene, nonadecene, eicosene, etc. While olefin hydrocarbons in general can be used, alpha or terminal olefins are preferred.

The chemical composition of the recovered reaction product of this invention cannot be characterized with preciseness by chemical structural formula. While it is believed that the above described reaction produces predominately Bis-dialkyl-1,3 thiazines, other side reactions in minor amounts can take place. In view of the nature of the reaction, the precise composition of the reaction product cannot be defined by its chemical structure, but must be defined by its method of preparation.

The hereindescribed reaction products of the present invention are effective oxidation inhibitors in oleaginous lubricant compositions when used in amounts of from about 0.1% to about 10% by weight. Suitable lubricating base oils are mineral hydrocarbon oils, i.e., petroleum oils, synthetic lubricating oils, such as those obtained by the polymerization of hydrocarbons, and other well-known synthetic lubricating oils. Concentrates of a suitable oil base containing more than 10%, i.e., from about 10% to about 75% or more, of the additive of the present invention, along or in combination with other additives, can be used for blending with base lubricating oils in proportions desired for particular conditions or used to give a finished product containing from about 0.1% to about 10% of the additive of this invention.

PREFERRED EMBODIMENT OF THE INVENTION

The following example is illustrative of the preferred embodiment of the present invention:

EXAMPLE A

Twelve grams (0.1 mol) of thio-oxamide, 33 grams (0.2 mol) of $C_{12}$-$C_{14}$ alpha-olefins, and 25.6 grams (0.2 mol) of capryl aldehyde was dissolved in 300 ccs. of chloroform. Under agitation the solution was cooled to 38° F. (3.3° C.), and 35 ml. of boron trifluoride etherate was added dropwise over a period of 30 minutes to the reaction mixture maintained at the temperature of 38° F. After an hour's reaction at 34°–48° F. an additional 20 mls. of the boron triflouride etherate was added, and the temperature allowed gradually to reach room temperature (about 78° F.) in a period of 10–12 hours. The reaction mixture was then poured over ice. Under agitation the chloroform-water mixture was neutralized with 40% aqueous sodium hydroxide until alkaline (pH 8). The chlorform phase was separated, and the aqueous phase washed with fresh chloroform. The combined mother liquor and the chloroform wash was dried over sodium carbonate and filtered. The filtrate (i.e., chloroform solution) was distilled under vacuum (about 100 mm. Hg.) at a temperature up to 260° F. An 80% recovery of finished reaction product was obtained.

The effectiveness of the reaction products of the present invention is demonstrated by the data in Table A, below. The data was obtained by subjecting lubricating oil compositions, hereinafter described, to the so-called "Oil Thickening Test" (OTT). This test, which evaluates the thickening, i.e., increase in viscosity, tendency of oils in severe service, is carried out in the following manner:

One hundred grams of the test oil are oxidized in an open oxidation tube by blowing with 60 ccs. air/minute at 340° F. Oxidation is catalyzed by the addition of 5% of a Ford VC drain oil. Samples are taken periodically and the viscosity thereof measured to obtain the viscosity-time curve. Sixteen and 24 hour samples are spotted to determine how well the oxidation inhibitor additive functions.

The base oil composition used in obtaining the data in Table A, below, was a lubricating oil composition containing 7% of a commercial Mannich lubricating oil dispersant, 0.7% dodecylsuccinic acid (rust inhibitor), 1.9% dodecyl phenol sulfide, 9% of a commercial VI improver, 41.2% of a solvent-extracted SAE 10 lubricating oil, and the balance a solvent-extracted SAE 5 lubricating oil. This base oil is referred to as "OIL A" in the Table A, below.

TABLE A

| Test No. | Oil | Inhibitor | Wt. % | 4Vo (4 Hrs.) | SDT @4Vo |
|---|---|---|---|---|---|
| 1 | A (Control) | a | 1.2 | 33 | Fail (50%) |
| | | b | 1.5 | | |
| 2 | A | c | 2.7 | 77 | Pass (100%) |
| 3 | A | 1c (large batch) | 1.2 | 96.5 | Pass (91%) |
| | | d | 1.5 | | |
| 4 | A | 1c | 1.2 | 80.5 | Pass (80%) |
| | | e | 1.5 | | |
| 5 | A | 1c | 0.7 | 112 | Pass (88%) |
| | | f | 2.1 | | |
| 6 | A | 1c | 2.7 | 79.5 | Pass (88%) |

Inhibitors:
a Commercial hindered phenol
b Commercial phospho-sulfurized hydrocarbon
c Reaction product of Example A
1c Large batch of Inhibitor c
d Commercial phospho-sulfurized wear inhibitor
e Commercial sulfurized wear inhibitor
f Tetramer of alkyl phenols In the OTT, the time required for the oil to reach fourfold viscosity increase (SSU), indicated by the symbol 4Vo(hrs.) must fall in the range of 30–40 hours to pass. The SDT at 4Vo, i.e., Spot Dispersency Test, rating must have a value of at least 80% to pass. Failing any one of these criteria means a "fail" for the oil composition being tested.

Although the present invention has been described with reference to a specific preferred embodiment thereof, the invention is not limited thereto, but includes within its scope such modifications and variations as come within the scope and spirit of the appended claims.

We claim:

1. The oil-soluble product prepared by the process comprising, (a) dissolving in an organic solvent in molar ratios from about 0.1 to about 1.0 mole of thio-oxamide, from about 0.2 to about 2.0 moles of a saturated aliphatic aldehyde having from 1 to about 20 carbon atoms, and from about 0.2 mole to about 2.0 moles of an olefin hydrocarbon having at least 8 carbon atoms, (b) agitating the solution while cooling the same to a temperature of about 34°–38° F., (c) adding to said cooled solution from about 10 parts to about 20 parts by weight boron triflouride etherate per 100 parts by weight of the solution of step (c).

2. The oil-soluble product prepared by the process of claim 1, wherein the olefin hydrocarbon comprises a $C_{12}$-$C_{14}$ alpha olefin.

3. The oil-soluble product prepared by the process of claim 1, wherein the aliphatic aldehyde comprises capryl aldehyde.

4. The oil-soluble product prepared by the process of claim 1, wherein the olefin hydrocarbon comprises a $C_{12}$-$C_{14}$ alpha olefin hydrocarbon, and the aliphatic aldehyde comprises capryl aldehyde.

5. A lubricant composition comprising a major amount of a normally liquid lubricating oil, and from about 0.1% to about 10% of the oil-soluble reaction product prepared by the process of claim 1.

6. A lubricant composition comprising a major amount of a normally liquid lubricating oil, and from about 0.1% to about 10% of the oil-soluble reaction product prepared by the process of claim 2.

7. A lubricant oil composition comprising, a major amount of a normally liquid lubricating oil, and from about 0.1% to about 10% of the oil-soluble reaction product prepared by the process of claim 3.

8. A lubricant composition comprising a major amount of a normally liquid lubricating oil, and from about 0.1% to about 10% of the oil-soluble reaction product prepared by the process of claim 4.

9. An addition agent concentrate for lubricating oils, comprising a lubricating oil containing from about 10% to about 75% of the oil-soluble reaction product prepared by the process of claim 1.

* * * * *